US005971237A

United States Patent [19]

Timbrook

[11] Patent Number: 5,971,237

[45] Date of Patent: Oct. 26, 1999

[54] HEIGHT ADJUSTABLE SAFETY COAT HANGER

[76] Inventor: Donald J. Timbrook, Rte. 10, Box 462, Lake City, Fla. 32025

[21] Appl. No.: 09/074,803

[22] Filed: May 8, 1998

[51] Int. Cl.[6] ..... A47G 25/14

[52] U.S. Cl. ..... 223/85; 223/DIG. 4

[58] Field of Search ..... 223/DIG. 4, 85, 223/92; D6/315, 328

[56] References Cited

U.S. PATENT DOCUMENTS

| | | | |
|---|---|---|---|
| 1,421,614 | 7/1922 | Taubman | 223/85 |
| 2,151,964 | 3/1939 | Gay | 223/85 |
| 2,370,391 | 2/1945 | Bolten et al. | 223/85 |
| 2,556,461 | 6/1951 | Baron | 223/DIG. 4 |
| 3,963,154 | 6/1976 | Schwartz et al. | 223/85 |
| 4,709,838 | 12/1987 | Campbell | 223/DIG. 4 |
| 5,328,068 | 7/1994 | Shannon | 224/42.46 A |

FOREIGN PATENT DOCUMENTS

| | | | |
|---|---|---|---|
| 1136803 | 9/1962 | Germany | 223/DIG. 4 |
| 171599 | 6/1960 | Sweden | 223/DIG. 4 |

*Primary Examiner*—Bibhu Mohanty
*Attorney, Agent, or Firm*—Thomas C. Saitta

[57] ABSTRACT

A clothes or coat hanger having an article-receiving member, generally triangular or V-shaped, connected to an extension member, where the extension member has a plural number of hook members, or a plural number of extension members and single hook member, for mounting the hanger onto a horizontal support rod. The hook members or extension segments are joined to each other and to the article-receiving member by connector members. The connector members separate such that individual hook members or extension segments can be removed from the extension member to shorten the hanger. Preferably, the connector members are constructed to automatically separate when a predetermined maximum weight limit is exceeded.

8 Claims, 3 Drawing Sheets

HEIGHT ADJUSTABLE SAFETY COAT HANGER

BACKGROUND OF THE INVENTION

The invention relates in general to coat or clothes hangers of the type used to hang articles of clothing from a horizontally extending rod, and more particularly relates to such devices which are height adjustable such that distance from the floor to the triangular article-receiving body of the hanger is adjustable, and further where the hanger has a safety mechanism whereby the triangular portion will separate from the hook member in the event weight in excess of the separation limit is applied to the hanger.

Simple devices for hanging articles of clothing, commonly referred to as coat or clothes hangers, are well known and extremely common. The coat hanger consists of either a triangular or an inverted V-shaped article-receiving body portion which depends from a hooked member. The hook member is usually rounded and is sized to fit over a horizontally extending rod mounted within a closet or formed as part of a garment display rack, such that the hanger may be removed from the rod by raising the hanger so that the open portion of the hook member clears the rod when the hanger is pulled away. The hanger is replaced by reversing the motion. Clothing or other articles are supported on the triangular of V-shaped portion of the hanger, either by inserting the sloping segments into the arm holes of a shirt, jacket, blouse, coat, etc., or by folding pants over the horizontal segment of the triangular type.

Such hangers are typically sized such that the hook extends only several inches above the article-receiving body, so that the clothing hangs only a few inches below the support rod, which is typically mounted 60 inches above the floor. This poses a problem for younger children or handicapped people, in that the hangers cannot be reached to remove or replace a garment, nor can the hanger be reached to remove it from or replace it on the rod. This problem has been addressed in a number of ways, such as by providing an extension member having a hook on one end and a loop on the other, such that the hook of a traditional coat hanger can be inserted through the loop, as seen for example in British Patent No. 1,423,902, issued to Fox in 1976. A drawback to this solution is that height of the hanger relative to the floor can only be changed by providing a shorter extension member to replace the original. Other configurations which mainly strive to increase the number of garments which can be hung in a single space utilize hangers with multiple article-receiving bodies, such as shown in U.S. Pat. No. 5,603,438 issued to Jugan in 1997, which provides a telescoping rod joining two article-receiving bodies, German Patent No. 3,804,226 issued to Tollkein in 1989 and British Patent No. 336,693 issued to Stewart in 1930, both showing multiple single article-receiving bodies connected vertically to a single hook, and U.S. Pat. No. 4,709,838 issued to Campbell in 1987, showing a number of inverted hooks descending vertically from the rod connecting hook, would because of their configurations allow garments to be mounted closer to the floor, but the designs are wasteful in that the upper article-receiving bodies would remain unused.

A separate consideration for an improved hanger is that of safety, in that there exists the possibility of accidental strangling should children or parts of their clothing become entangled in the hangers suspended too great a distance above the floor. Even the known multiple piece hangers are not designed to separate to protect a child.

It is an object of this invention to provide an improved coat or clothes hanger which is height adjustable such that the distance from the horizontal rod to the article-receiving body portion of the hanger, and thus simultaneously the distance from the floor to the article-receiving body, can be altered to provide easy access to children or handicapped people who can reach only a limited distance above the floor. It is a further object to provide such a hanger which can be adjusted to raise the article-receiving body as a child grows. It is a further object to provide such a hanger where parts of the structure are removable as the hanger is adjusted for height. It is a further object to provide such a hanger which has a safety mechanism such that the article-receiving body will separate or break away from the hook portion encircling the support rod should weight in excess of a predetermined maximum load be applied to the hanger. These and other objects which may become apparent are fulfilled by the invention disclosed below.

SUMMARY OF THE INVENTION

The invention is a hanger used primarily for hanging articles of clothing from a horizontally extended rod, such as found in closets or on garment racks. The hanger has a triangular or inverted V-shaped article-receiving body portion on which the clothing is positioned for storage or display. A vertically oriented extension member extends from the apex of the article-receiving member. The extension member is comprised of a number of hook members, each of which is sized and configured so as to retain the hanger on the horizontal support rod. Each hook member is separable from the adjoining hook member, such that the distance of the hanger from the floor can be increased, and the distance between the article-receiving member and the rod can be decreased, by removing one or more hook members. The hanger may be constructed of any suitable material, including metal or wood, but is preferably constructed of plastic.

The hanger may be constructed as a single member with the hook members adjoined by breakable connecting portions, narrower in cross-section than the other portions of the hanger, or in multiple pieces where the hook members are joined by separable connectors using mechanical interlocks, friction fittings, detents, or the like. The connectors or connecting portions are structured such that the elements will separate upon the application of excess weight to the hanger in order to provide a safety feature should a young child or its clothing become entangled in the hanger.

In an alternative construction, a single hook member can be connected to the article-receiving member by a number of separable extension member segments. The relative height of the article-receiving member is adjusted by removing or adding extension member segments. In another alternative construction, the device may comprise a hook receiving means positioned lowermost on the extension member, such that the hook of a traditional hanger may be retained thereby. Preferably the hook of the traditional hanger is securely received such that pitch, yaw and rotation is prevented.

DETAILED DESCRIPTION OF THE INVENTION

With reference to the drawings, the invention will now be described in detail with regard for the best mode and preferred embodiments. In general, the invention is a hanger primarily intended for hanging clothing in a closet or on a garment display rack, a device which is commonly referred to as a coat or clothes hanger. The clothing is draped onto the lower portion of the device, and the upper portion of the hanger, consisting of a hooked portion, is placed onto a horizontal support rod, such that the clothing hangs vertically a distance above the floor. The invention is a hanger where the article-receiving body portion is height adjustable relative to the horizontal support rod, and therefore height adjustable relative to the floor, such that the article-receiving body of the hanger can be positioned at various heights to compensate for the limited reach of a child or handicapped person, and in particular such that the article-receiving body portion of the hanger can be incrementally raised as a child grows and is able to reach higher.

Figure 1:
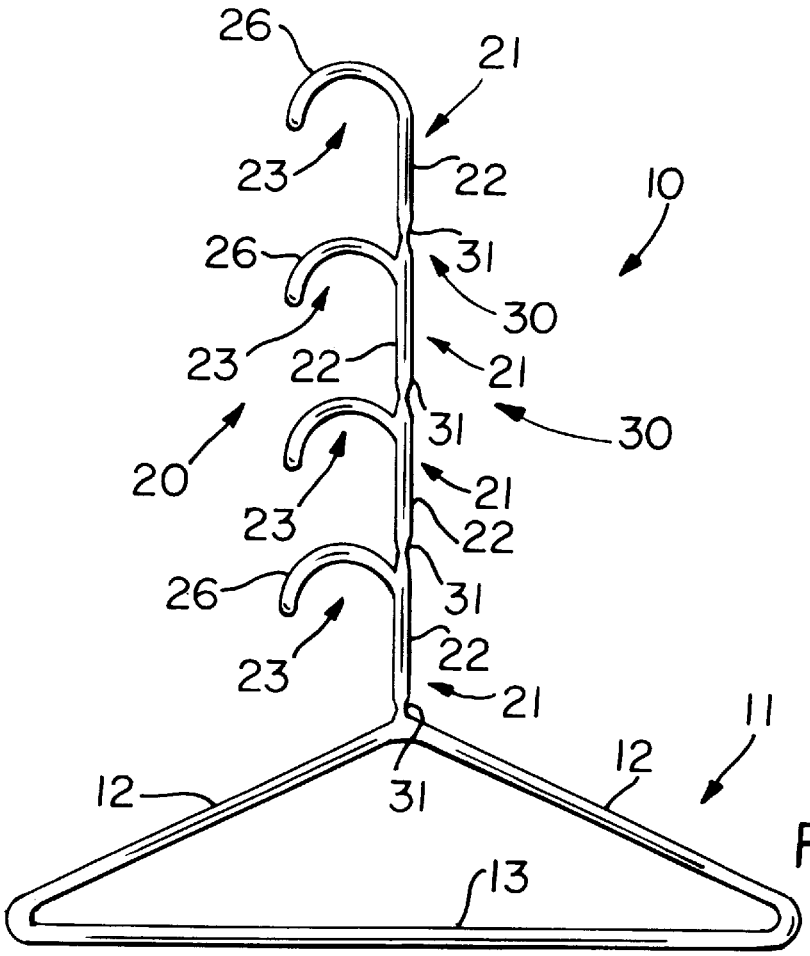
FIG. 1 is a view of the invention formed as a single member showing the hook members connected by breakable neck portions.

Referring now to FIG. 1, an overall view of the main embodiment of the clothes or coat hanger 10 is illustrated. The hanger 10 mainly comprises an article-receiving body member 11, an extension member 20 comprised of hook members 21 comprising curved hook segments 26 joined to vertical depending segments 22, and separable connector means 30 which join the hook members 21 to each other and to the article-receiving member 11. The hanger 10 may be composed of any material of suitable strength and rigidity, but it is preferable that the hanger 10 be constructed of plastic. The article-receiving member 11 is preferably triangular in shape as shown, having a pair of angled arms 12 extending laterally and joined by a cross bar 13. This configuration allows shirts, blouses, coats, etc. to be retained thereon by inserting the angled arms 12 into the arm holes of the garment, and further allows other items such as pants, ties, etc., to be retained by folding the garment over the cross bar 13. Alternatively, without departing form the spirit of the invention, the article receiving member 11 may be formed as an inverted V-shape, with a pair of angled arms 12 but no cross bar 13.

Extending from the apex of the article receiving member 11 is a multiple component, adjustable-in-length, extension member 20. Extension member 20 is comprised of a plural number of hook members 21, and forms the means by which the article receiving member 11 is retained on a horizontal support rod in a closet or on a garment rack. The extension member 20 is also the means by which the overall height of the hanger 10 can be altered in order to vary the distance of the article-receiving member 11 from the support rod and from the floor. The hook segment 26 of each hook member 20 is curved to create an opening 23 which allows the hanger 10 to be placed onto the support rod, the hook segment 26 preventing the hanger 10 from falling off the support rod even if the hanger 10 is rocked. As seen in FIG. 1, the hanger 10 may be formed as a single piece, meaning that the extension member 20 comprises a plural number of hooks 21 joined linearly by interspersed depending segments 22. In general, the overall height of the hanger 10 is preferably about 28 inches, with each hook member 21 separated by about 4 to 6 inches, thereby lowering the article-receiving member 11 about one and a half feet in comparison to a traditional hanger. The stated dimensions are not critical to the function, and the particular dimensions may vary without departing form the invention as contemplated.

In order for the hanger 10 to be height adjustable, separable connector means 30 are provided which allow the extension member 20 to be shortened by removing one or more hook members 21. In the single piece construction of FIG. 1, the connector means are neck members 31 which have a reduced cross-section relative to the cross-section of the depending segments 22, such that a hook member 21 can be removed from the extension member 20 by cutting or forcibly breaking the neck member 31 at the desired point of separation. In this manner, when the height of the hanger 10 is to be shortened to raise the article receiving member 11, to account for example for the growth of a child, the uppermost hook member 21 is removed by separating the connector means 30 joining it to the next hook member 21. The hook member 21 previously adjoining the removed combination is now used to receive the support rod to mount the hanger 10. Further adjustments are made in the same manner, until eventually all but one of the hook members 21 has been removed from the extension member 20, with the result that the hanger 10 is now sized generally equivalent to a standard hanger.

Figure 3:
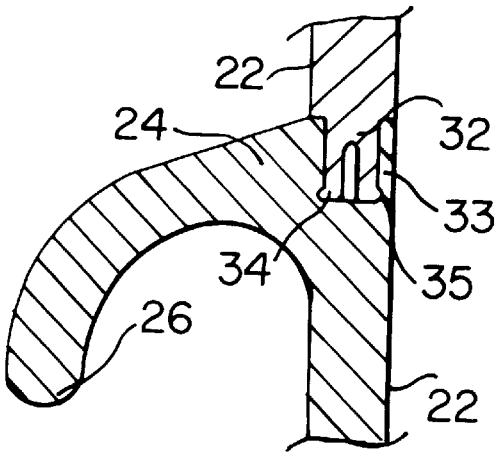
FIG. 3 is a cross-sectional view of an alternative construction for the hook members.
Figure 2:
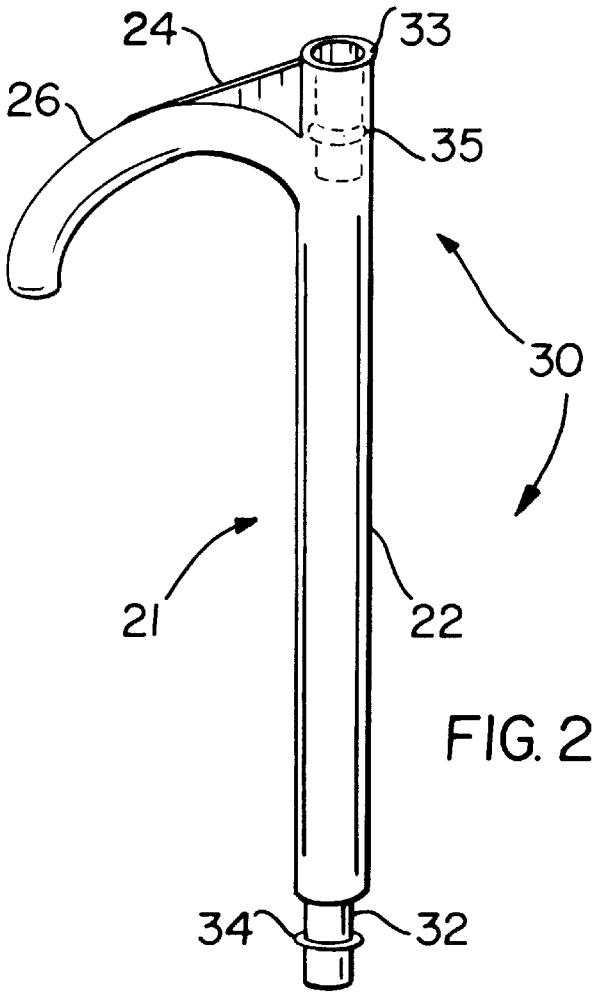
FIG. 2 is a view of an individual hook member.

Alternative embodiments for the extension member 20 are illustrated in FIGS. 2 and 3. Here the extension member 20 is not formed as a single piece, but is instead comprised of a plural number of individual hooks 21, each detachably connected to another hook member 21 or to the article-receiving member 11. As shown in FIG. 2, the connector means may comprise the combination of a male connector 32 on one end of a depending segment 22 and a corresponding female connector 33 on the opposite or upper end. The male and female connectors 32 and 33 may be sized to simply mate as a friction fitting, but preferably are provided with correspondingly configured detent members 34 and channels 35. Likewise, it is preferable that the male and female connectors 32 and 33 be non-circular in cross-section, such as for example D-shaped, to prevent unwanted rotation of the components. To shorten the hanger 10, the uppermost hook member 21 is separated from the adjoining hook member 21. FIG. 3 shows another alternative embodiment for the connector means 30, where the end of the male connector 32 is slotted between the detent members 34 for easier assembly, the slot allowing the sides to be compressed for insertion. It is also preferable that a raised ridge or webbing member 24 extend between the connector member 30 and the hook segment 26 on each hook member 21 to preclude entrapment of strings or laces.

Figure 5:
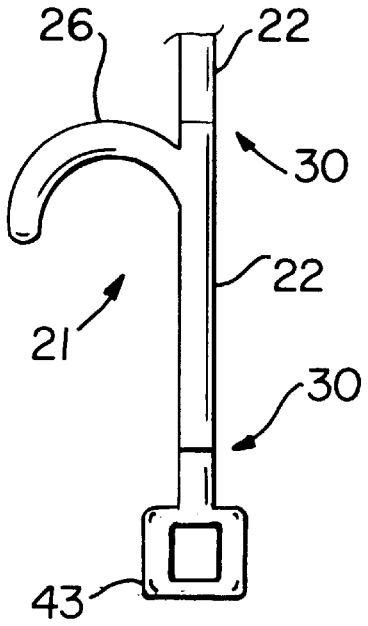
FIG. 5 is a view of an alternative structure for the hook receiving member.
Figure 4:
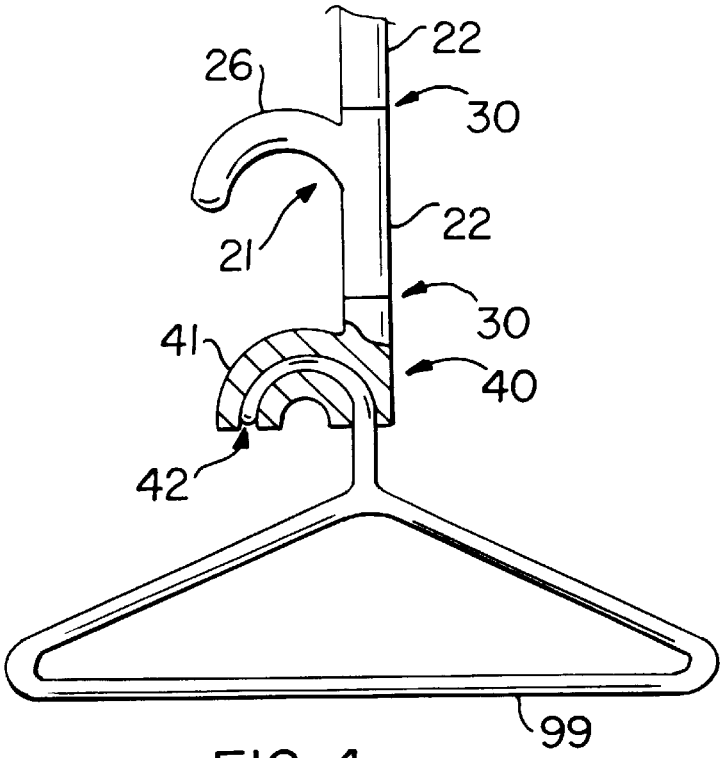
FIG. 4 is view of a hook receiving member shown mostly in cross-section which receives the hook of a traditional hanger.

Still another set of embodiments for the invention is illustrated in FIGS. 4 and 5. In this construction, a traditional hanger 99 is used to retain the clothing. The hook of the traditional hanger 99 is inserted through hook-receiving means 40, which may comprise a curved segment 41 having and internal bore 42, as shown in FIG. 4, or a loop member 43, as shown in FIG. 5, or other suitable configuration for accomplishing the task of retaining the traditional hanger 99. The extension member 20 is provided as described above, such that the hook members 21 may be individually removed to raise the hanger 99. It is preferred that the hook-receiving means 40 securely and snugly receive the hook of the traditional hanger to prevent any pitch, yaw or rotation of the traditional hanger 99 relative to the hanger 10 of the invention.

Figure 6:
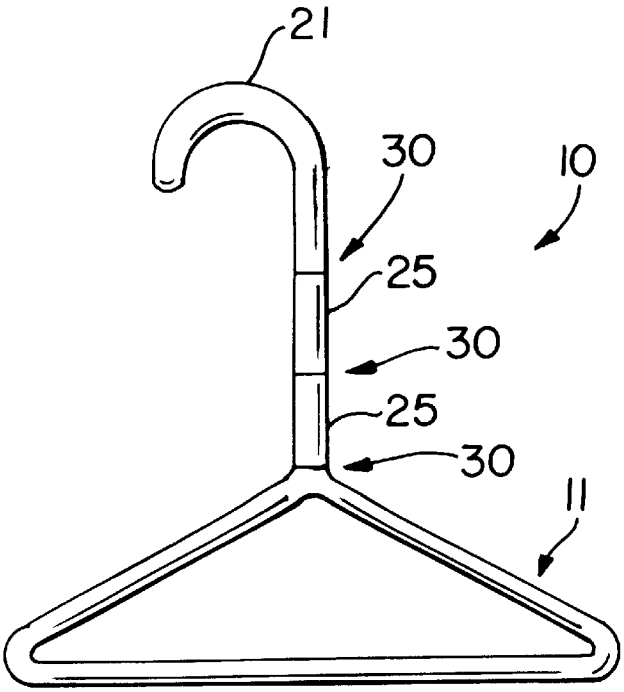
FIG. 6 is a view of the invention where a number of straight extension segments are used with a hook member.

Still another embodiment is illustrated in FIG. 6, where the multiple component extension member 20 is comprised of a single hook member 21, plus at least one and preferably a number of straight extension segments 25, all joined as before by connector means 30 to each other and to the article-receiving member 11. Reduction in the overall length of the hanger 10 is accomplished by removing individual extension segments 25 between the hook member 21 and the article-receiving member 11. In this embodiment, the remaining non-connected connector means 30 must be able to be reconnected after separation and removal of the extension segment 25, meaning that the frangible neck members 31 cannot be utilized. Furthermore, the hook member 21 is joinable directly to the article-receiving member 11.

As a further improved feature, the connector means 30 are designed such that they will either automatically break, in the case of the single piece unit with neck members 31 of FIG. 1, or automatically separate, in the case of the mechanical or friction fit connectors 32 and 33 of FIGS. 2 and 3, when weight is applied to the hanger 10 in excess of a predetermined maximum amount. Preferably, the connector means are designed to break or separate at about 20 pounds, thus insuring that should a child become entangled in the hanger 10, the hanger 10 will separate from the hook member 21 encircling the support rod. For the neck members 31, the separation threshold is determined by properly configuring the neck member 31 dependent on the type of plastic employed, and for the interconnecting connecting means 30, the separation threshold is determined by properly configuring the detent members 34.

It is contemplated that certain equivalents and substitutions for particular elements set forth above may be obvious to those skilled in the art, and the true scope and definition of the invention therefore is to be as set forth in the following claims.

I claim:

1. A clothes hanger comprising an article-receiving member and an extension member, said article-receiving member comprising at least a pair of angled arms, said extension member being connected to said article-receiving member and comprising a plural number of support rod receiving hook members, said hook members having a curved hook segment and an opening to receive a support rod to maintain said hanger thereon, where said hook members are joined by connector means such that all of said individual hook members are separable from each other and from said extension member, where said hook members further comprise depending segments joined to said hook segments, and where said connector means are neck members which are smaller in cross-section than said depending segments.

2. The hanger of claim 1, where said connector means separate when a predetermined maximum weight is applied to said hanger.

3. The hanger of claim 2, where said maximum weight is about 20 pounds.

4. A clothes hanger comprising hook-receiving means and an extension member, said extension member comprising a plural number of support rod receiving hook members joined by connector means, where said hook receiving means is joined to one of said hook members, and where said hook receiving means receives the hook of a traditional hanger to suspend said traditional hanger from said hook receiving means, where said hook members comprise depending segments joined to hook segments, and where said connector means are neck members which are smaller in cross-section than said depending segments.

5. The hanger of claim 4, where said connector means separate when a predetermined maximum weight is applied to said hanger.

6. The hanger of claim 5, where said maximum weight is about 20 pounds.

7. The hanger of claim 5, where said hook-receiving means comprises a curved segment with a bore.

8. The hanger of claim 5, where said hook-receiving means comprises a loop member.

* * * * *